United States Patent [19]

McKnight

[11] 4,314,805

[45] Feb. 9, 1982

[54] LAUNDRY PROCESS AND METHOD FOR TREATING TEXTILES

[76] Inventor: Eugene A. McKnight, 7727 Meadow Rd., #229, Dallas, Tex. 75230

[21] Appl. No.: 215,454

[22] Filed: Dec. 11, 1980

Related U.S. Application Data

[63] Continuation of Ser. No. 88,873, Oct. 29, 1979, abandoned, which is a continuation of Ser. No. 871,678, Feb. 16, 1978, abandoned, which is a continuation-in-part of Ser. No. 828,757, Aug. 29, 1977, abandoned.

[51] Int. Cl.[3] ..... B08B 3/00

[52] U.S. Cl. ..... 8/137; 8/115.6

[58] Field of Search ..... 8/115.6, 137

[56] References Cited

U.S. PATENT DOCUMENTS 3,238,166 3/1966 Kawai et al. ..... 8/115.6 A 4,057,503 11/1977 Graver et al. ..... 8/137

OTHER PUBLICATIONS

Nuessle, A. C. et al., Textile Research Journal, 1963, 33, (No. 1), pp. 146–160.

*Primary Examiner*—A. Lionel Clingman

*Attorney, Agent, or Firm*—Sigalos & Levine

[57] ABSTRACT

A method for treating a textile to give it improved soil resistance comprising contacting said textile with a solution of a polyvinyl alcohol and thereafter drying said textile.

5 Claims, No Drawings

LAUNDRY PROCESS AND METHOD FOR TREATING TEXTILES

CROSS-REFERENCE TO RELATED APPLICATIONS

This application is a Continuation of Application Ser. No. 088,873 filed Oct. 29, 1979, which is a Continuation of Application Ser. No. 871,678 filed Feb. 16, 1978 (now abandoned) which is a Continuation-In-Part of Application Ser. No. 828,757 filed Aug. 29, 1977 (now abandoned).

BACKGROUND OF THE INVENTION

This invention relates to an improved laundry process and method for treating textiles to improve soil anti-redeposition properties in laundering, to add soil release and soil resist properties to the textiles in laundering, to add increased soil suspension properties to detergents in laundering, and to treat textiles to give them soil release and soil resist properties.

It has long been known that textiles have improved appearance and feel when they are treated with sizing agents. Such sizing agents as starch, resinous polymers and the like, have long been used to improve the properties of textiles. Attempts have been made to permanently size various textiles whereby the appearance and feel of the textiles is somewhat permanent even after the textile has been subjected to washing or dry cleaning several times. While some progress has been made in this area, it is generally accepted that textiles gradually lose their body and become rather flimsy after the textile has been subjected to repeated washing and/or dry cleaning. This phenomenon is caused either by the sizing agent being removed from the textile in the repeated washing or dry cleaning steps or by a breakdown or decomposition of the sizing agent. This constitutes an important area of fabric maintenance or restoration in laundry processes.

It is also appreciated in the cleaning arts that there is a need for materials and components to improve the efficiency of detergents for removing soil from textiles. Many different products have been utilized as soil release agents. Such soil release agents to improve the ability of a textile to be washed or otherwise treated to remove soil and/or oily materials include various organic and inorganic materials. Generally speaking, such soil release agents have not functioned effectively enough to obtain general acceptance or effective enough to extensively reduce energy and supply costs.

It is also known in the laundry and dry cleaning arts that it is highly desirable to incorporate various components into textiles to improve the soil anti-redeposition properties of the fabric. Many types of soil anti-redeposition agents have been suggested in prior art. These components are normally incorporated into soaps and detergents to prevent the redeposition of soil onto fabrics and textiles during washing, shampooing, laundering and dry cleaning. Such materials include compounds such as carboxymethy cellulose, cyanoethylated starches, alkaline hydrolyzed polymers and the like. Presently, such products are not entirely satisfactory.

There is a need for a process that can serve in one step and with one component to give textiles soil release, soil resist, and anti-redeposition properties.

SUMMARY OF THE INVENTION

The present invention provides method for treating and laundering textiles to give them improved soil release and soil resist properties, and/or improved soil anti-redeposition properties, said properties hereinafter collectively referred to as "soil resistance", utilizing only one step and one component.

Briefly stated, the present invention comprises a method for treating a textile to give it improved soil resistance comprising contacting said textile with a solution of a polyvinyl alcohol and thereafter drying said textile. In its preferred embodiment, the invention comprises contacting the textile with a solution of a polyvinyl alcohol in the last aqueous bath of a wash cycle before extracting and then drying the textile.

DETAILED DESCRIPTION

As used herein, the term "textile" refers to any fabric, garment, material or the like, made from naturally occurring or synthetic fibers.

In the instant invention, several distinct advantages are obtained by contacting a textile with a solution of a polyvinyl alcohol. By contacting the textile material, for example, with the solution at the end of the wash cycle, normally in the final rinse cycle just before extraction, a substantial amount of the polyvinyl alcohol will be deposited in or on the surfaces of the textile. This deposition of the polyvinyl alcohol occurs even when the concentrations of the polyvinyl alcohol are quite low in the solution. Upon drying of the textile to remove the water, a protective layer, or film, of polyvinyl alcohol is formed on the textile. It has been found that suspensions or emulsions of polyvinyl alcohol are not operative since the polyvinyl alcohol does not become sufficiently soluble during the normal times and temperatures of the laundry cycle. If the suspensions or emulsions are added with the detergent in the wash cycle, they are removed during the rinse cycles before any significant amounts go into solution. If added to the last bath before extraction, the polyvinyl alcohol in the suspension or emulsion does not go into solution because of the short time and low temperatures of such cycle.

This invention requires that an aqueous solution of a polyvinyl alcohol be formed prior to being contacted with the textile. In a conventional laundry process, the solution can then be added to the final rinse of the wash cycle. As a result of the deposition properties of the polyvinyl alcohol, a considerable amount is deposited in or on the textile from the solution. Upon the removal of the excess water from the textiles following such contacting with the polyvinyl alcohol solution in the final rinse of a wash cycle during the extraction cycle and upon drying, the textile materials will have an improved body and feel resulting from the polyvinyl alcohol film on the textile. Thus, the polyvinyl alcohol polymer inherently functions as an improved sizing agent as part of its overall function as a soil resist and release, as a soil suspension agent, and as an anti-soil redeposition agent, making possible the subsequent use of reduced water temperature and of cleaning supplies.

The properties of the textile material that have been treated with solution of a polyvinyl alcohol during the final rinse of the wash cycle are quite surprising. For example, in addition to the superior sizing properties, there appears to be no "buildup" of the polyvinyl alcohol in the textile material, even after any number of washing, pressing, or laundering cycles due to its complete and rapid solubility in even cold water. Thus, the "old" film is removed in the wash cycle when the textile is to be washed. Additionally, such treatment during the final rinse cycle produces a textile having an outstanding appearance that resembles the appearance of a new textile material, particularly when pressed damp. It has also been observed that the treated textile materials have improved wearing qualities or properties and will stand up under many more wash or laundering cycles, and more wear than untreated textile materials, thus greatly prolonging the longevity and improving the wearing properties of the textile materials. Moreover, large reductions in water temperature, detergent, and alkali are made possible by the soil resist and release properties of the polyvinyl alcohol in subsequent washings and undoubtedly also contribute heavily in increased garment or fabric life. It has been observed that when a textile is treated with the polyvinyl alcohol solution during the final rinse cycle, and thereafter dried, that a residual effect occurs in the textile, wherein soil, in the form of dirt, grease, and other materials, is more easily washed from the fabric during the next wash cycle, as well as soil anti-redeposition properties being substantially improved and the soil suspension properties of the detergent being enhanced resulting in faster removal in rinsing. The residual properties of the polyvinyl alcohol result from its being on and/or in the textile after drying which follows the final rinse. The residual properties of the "film" of polyvinyl alcohol reduces the attraction and penetration of soil, particularly oily soil into the textile, and thus improves the efficiency of the detergents and alkalis to a point in subsequent washing where the amount of detergent and alkali can be substantially reduced, as well as the wash water temperature in order to obtain the same degree of cleaning of the textile.

It has also been observed that the properties of the textile materials that are treated with the polyvinyl alcohol solution during the final rinse cycle are more easily pressed or ironed to produce a finished textile product having a superior appearance, feel, and body, which also reduces the effects of friction in both wear and washing, which last longer than similar textiles that have not been so treated.

It should be understood that the incorporation of the polyvinyl alcohol solution in the final rinse cycle of a laundering or washing cycle in accordance with this invention can be without a souring agent. Such souring agents, which are normally acids to neutralize any alkanlinity from soaps or detergents used in the washing or laundering cycle, are well known in the art. It should also be appreciated that the instant solutions of polyvinyl alcohol can be used in combination with other additives such as optical brighteners, deodorants, bacteriocides, coloring agents, softeners, moth-proofing agents, anti-mildew agents, sizing agents, anti-static agents, and the like.

In another embodiment of this invention, the polyvinyl alcohol solution can be added to the initial portions of a wash or laundering cycle to improve the soil release properties and to improve the soil anti-redeposition properties and the soil suspension properties of a system utilized to wash or launder textiles. For example, the polyvinyl polymer solution can be added along with a soap or detergent system to substantially improve the efficiency of the soap or detergent in removing soil from the textile products. It has been found that the addition of the polyvinyl alcohol polymer solution to a detergent system will enhance the anti-redeposition properties, soil suspension properties, whiteness retention, and soil release properties of the detergent system, thereby allowing substantially reduced amounts of the detergent to be utilized in the washing or laundering system. It, of course, will be appreciated that this is a distinct advantage for detergent manufacturers and users of such detergents in view of the apparent loss of many of the very valuable properties of materials such as phosphates that were formerly used in detergents. Not only will the amount of detergent or soap needed to carry out the necessary washing or laundering cycle be reduced, but it is also possible to substantially reduce the temperature of the washing or rinsing and still obtain the desired cleaning effect.

It has been found that when the polyvinyl alcohol solution is added to the wash cycle that substantially none of the subsequent advantages of the polyvinyl alcohol as discussed above, will be noted in the finished textile material. Apparently, all of the polyvinyl alcohol will be washed from the textile materials unless it is incorporated in the final rinse cycle.

The polyvinyl alcohol solutions that are utilized in the instant invention are preferably aqueous solutions that can be added either to the final rinse cycle to aid the detergent with soil resist properties in subsequent washing, or to be added to the early washing stages of the laundering and washing processes to only aid the detergent process or to textiles before they are initially used to give soil resistance properties to the textile.

Polyvinyl alcohol is a water-soluble polymer made by alcoholysis of polyvinyl acetate whose properties, in the main, depend on degree of polymerization and degree of hydrolysis. In the present invention it is possible to use any of the polyvinyl alcohols, including alkoxylated derivatives thereof, so long as they are water soluble. It is possible, therefore, to use partially hydrolyzed or fully hydrolyzed materials of low, medium, or high viscosity. It is preferred to use fully hydrolyzed (about 98 to 99%) and medium viscosity (about 28 to 32 cps) polyvinyl alcohol such as that sold by Air Products and Chemical Company, Inc. under the name VINOL 325.

The polyvinyl alcohol solutions preferably contain about 2 to 15% by weight of polyvinyl alcohol for each 100% by weight of the solution. While higher concentrations of polyvinyl alcohol can be used, they are not as suitable since the solutions tend to be too viscous. The solutions are preferably prepared by presolubilizing or slurrying the polyvinyl alcohol in an aqueous solution using heat, 85° C. to 95° C., to obtain the highest concentration of solution and then diluted to the concentration desired, even in cold water. It can be added in such fashion to treat a textile before its use, to the last bath of a laundry wash cycle, with the detergent to the first bath of a wash cycle, or sprayed or otherwise applied to a textile selected to be pretreated individually as in pressing or ironing. No chemical additions or pH control is necessary with the use of the polyvinyl alcohol solution.

Any effective amount of the polyvinyl alcohol solution can be added to the final rinse or to the detergent wash cycle in laundering to achieve the desired results. It has been found, however, that it is generally preferred to use low levels of the polyvinyl alcohol solution since large amounts are not needed to achieve the desired results.

By way of example, 32 fluid ounces of a 2% by weight polyvinyl alcohol solution or 12 to 16 fluid ounces of an 8% by weight polyvinyl alcohol solution can be used for each 100 parts by weight of textile to be treated. This is added to the final rinse cycle. However, the amount of this solution added by volume per pound to the textile to be treated may vary, dependent upon high or low soil levels, and on the users' choice and/or cost preferences. The foregoing ranges are based on the percent by weight of polyvinyl alcohol polymer solids in the total rinse or wash system per 100 parts by weight of dry textile material. It should be remembered that a lower volume of cold water is usually used in the final rinse than in any of the other washing operations, and that this lower volume of water raises the concentration of polyvinyl alcohol polymer in the washer compared with other materials used in higher volumes of water in the washer.

The textiles that are treated in accordance with this invention include cotton textiles, blends of cotton and polyester materials, polyester materials, woolen materials, rayon materials, nylon materials and the like. Cotton materials and cotton-polyester blend materials are particularly preferred for treatment in accordance with this invention.

Experience teaches that pre-solubilization of polyvinyl alcohol with heat is of the greatest importance to assure full solubilization and renseability; to avoid waste or ineffectiveness of polyvinyl alcohol; or other physical or chemical maneuvers to avoid some insolubility. Presolubilization is best accomplished from a slurry form.

The various embodiments of this invention as discussed above, have utility in home laundry processes, coin operated (laundromat) processes, commercial and industrial laundry processes, commercial and dry cleaning processes, and in various textile manufacturing processes. As will be appreciated by those skilled in the art, the essential steps of the invention are in the actual contacting of an aqueous solution of the polyvinyl alcohol with the textile to be treated.

In some instances, it may be desired to add the solution to the textile by either spraying or dampening the textile material with the same in low concentrations, as after extraction in washing, before it is pressed. In such instances, the polyvinyl alcohol will remain deposited on or in the textile structure to give soil resistance properties in the sprayed area to aid in soil removal in the sprayed area in the next washing, and also in overall soil suspension and anti-redeposition in the next washing.

It has been noted that the treatment of textiles with the polyvinyl alcohol solution greatly improves the efficiency of washing or laundering steps wherein even oil spots and oily soil can be washed from the textile with great ease even when the temperature of the wash liquid is decreased and even when the amount of detergent used is greatly decreased. This, of course, is a desirable property in that it is possible to remove oily stains, oily soil and the like from textiles without the now accepted procedure of first dissolving the oil in a solvent or by running the soiled textile through a dry cleaning solvent bath, or by using large amounts of detergents, alkalies, and other specialty cleaners, with high water temperatures as up to 200° F. in washing. Thus, the control by the instant invention of oily, greasy soil in laundry processing can be used to replace dry cleaning for other than fragile materials.

The following example is presented to illustrate the embodiments of the present invention. The examples given are for illustrative purposes only, and are not intended to limit the scope of the invention in accordance with known procedures by the alcoholysis of polyvinyl acetate.

EXAMPLE

Polyvinyl alcohol (approximately eight ounces by volume) (VINOL 325) was added to a small amount of water and stirred at a temperature of about 100° F. to 110° F. to form a slurry. After the slurry was formed, additional water at the same temperature was added to bring the volume to one gallon and the temperature raised to 140° F. to 150° F. The thus formed mixture was a clear liquid containing about 4% by weight of polyvinyl alcohol.

An extensive test was carried out wherein soiled work clothes and uniforms that were used in industrial service were washed in an industrial laundry facility. The same soiled work clothes were washed three times a week in batches of 200 pounds of the soiled clothes per batch. The initial test was begun by washing the soiled work clothes in industrial laundry equipment using a commercially available "built" detergent in water at 190° F. Five pounds of the "built" detergent (built with alkalis) were utilized during the initial tests. In all runs, one ounce of diluted glacial acetic acid sour per 100 pounds of garments was used in the last rinse with the addition of one quart of the above aqueous solution of polyvinyl alcohol polymer being added to the last rinse. The tests were continued for three weeks with the addition of the above polyvinyl alcohol solution to the last cycle in each of the washings, and it was found that the cleaned work clothes, when pressed or not, had a superior feel and appearance that had not been obtained when the same work clothes were washed on previous occasions without the addition of the above-mentioned polymer. Additionally, the work clothes had an additional color clearness and also, importantly, the press operators claimed a savings of three to four hours daily by not having to remove sizing buildup, as with starch, from the press machine surfaces. Tests were then carried out in which the amount of detergent and alkali was gradually reduced and the water temperature was gradually reduced over a period of three weeks. At the end of this period, it was found that the same clothes could be washed to the same degree of cleanliness and brightness when only two pounds of detergent and alkali was used per batch, and when the wash water temperature was reduced from 190° F. to 130° F. Even at the low detergent level and the low wash temperature, the addition of the above-noted polyvinyl alcohol solution to the final rinse cycle produced equally clean work clothes with superior feel and appearance characteristics as opposed to work clothes washed without the polymer.

Trials and mixtures of other water soluble grades of Vinol (polyvinyl alcohol polymers) produced equally good results.

It was learned that 16 to 24 ounces by volume of polyvinyl alcohol in each gallon of water could be prepared as a clear liquid by increasing the time and temperature of the heating period. The use of 24 ounces by volume of polyvinyl alcohol resulted in a viscous, difficult to handle solution, while the use of 16 ounces by volume of polyvinyl alcohol proved more satisfactory, and reduced the amount of solubulized polyvinyl alcohol used for 100 pound textile from one quart to 16 ounces. The process of pyrolysis on the property of plasticity of the polyvinyl alcohol is suggested here.

In connection with the suggested action of pyrolysis on the property of plasticity, three things are positive. Pyrolysis is the transformation of a compound by heat alone. The instant soil release is created by the action of heat alone on granular polyvinyl alcohol when placed in a solvent into a film-forming solution which cannot be accomplished otherwise in or under the conditions of the laundry process. Plasticity is a property of materials expressed as to the degree they will deform under applied stress and retain the induced condition. The film resulting from the film-forming solution is absolutely required in order to obtain an effective soil release and resist, especially on oily soils and cannot be duplicated by the action of suspensions of polyvinyl alcohol or emulsions, or otherwise. No other process utilizes heat to create a film-forming solution following the evaporation of its water in a laundering process to give the unexpected properties found herein.

Two large plants were test operated at full capacity during which time it was determined to base the amount of polyvinyl alcohol solution used per 100 pounds of material washed in the soil on the soil level of the material as low, medium, or high. It is believed the highest possible soil level is on ink towels and shop towels. One customer required thousands of new white towels weekly. By treating such towels prior to use with the polyvinyl alcohol solution, they could be washed and returned as new the second week due to a complete control of redeposition. Even ink towels were maintained practically like new with treatment before starting use. Reduction in supply, energy, and other costs as previously detailed above are realized.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A method for laundering a textile to give it improved soil resistance comprising contacting said textile with a pre-solubilized aqueous solution of a polyvinyl alcohol in the last bath of the laundry process and thereafter drying said textile.

2. The method of claim 1 wherein the solution of polyvinyl alcohol is an aqueous solution containing from about 2% to 15% by weight of polyvinyl alcohol.

3. A method for laundering a textile to give it improved soil resistance consisting essentially of immersing said textile in the last laundering water bath containing pre-solubilized aqueous polyvinyl alcohol in solution, removing said textile from said water bath, and then drying said textile.

4. The method of claim 3 wherein the amount of pre-solubilized aqueous polyvinyl alcohol solution added to said water bath is dependent upon the textile weight and polyvinyl alcohol concentration in the polyvinyl alcohol solution and varies, for each 100 pounds by weight of textile, from about 32 fluid ounces for a 2% by weight polyvinyl alcohol solution to about 12 to 16 fluid ounces for an 8% by weight polyvinyl alcohol solution.

5. The method of claim 3 or 4 wherein the water bath is the sour bath of a commercial laundry operation.

* * * * *